US006689243B2

(12) United States Patent
Scott et al.

(10) Patent No.: US 6,689,243 B2
(45) Date of Patent: Feb. 10, 2004

(54) APPARATUS AND METHOD FOR DISPENSING LABELS ONTO CYLINDRICAL ITEMS

(75) Inventors: Robert B. Scott, Xenia, OH (US); James A. Fowler, III, Tipp City, OH (US)

(73) Assignee: Delphi Technologies, Inc., Troy, MI (US)

( * ) Notice: Subject to any disclaimer, the term of this patent is extended or adjusted under 35 U.S.C. 154(b) by 262 days.

(21) Appl. No.: 09/754,503

(22) Filed: Jan. 3, 2001

(65) Prior Publication Data

US 2002/0084020 A1 Jul. 4, 2002

(51) Int. Cl.[7] ..... B65C 3/00

(52) U.S. Cl. ..... 156/215; 156/218; 156/485; 100/18; 100/33 PB

(58) Field of Search ..... 156/215, 258, 156/249, 542, 483, 484, 540, 541, DIG. 6, DIG. 10, DIG. 27, DIG. 33, DIG. 39, DIG. 40, 213, 485; 100/18, 33 PB

(56) References Cited

U.S. PATENT DOCUMENTS

| | | | | |
|---|---|---|---|---|
| 2,367,189 A | * | 1/1945 | Avery | |
| 2,402,357 A | | 6/1946 | Bates | |
| 3,140,214 A | | 7/1964 | Von Hofe | |
| 3,922,834 A | * | 12/1975 | Clayton | 53/139.1 |
| 3,954,542 A | | 5/1976 | Solomon et al. | |
| 3,954,543 A | | 5/1976 | Messmer | |
| 3,954,545 A | * | 5/1976 | Hamisch | |
| 4,129,473 A | | 12/1978 | Perret | |
| 4,473,429 A | * | 9/1984 | Crankshaw | 156/483 |
| 4,643,786 A | | 2/1987 | Cecchi | |
| 4,711,687 A | | 12/1987 | Paules | |
| 5,902,449 A | | 5/1999 | Moore | |
| 6,230,778 B1 | * | 5/2001 | Latwesen | 156/483 |
| 6,238,509 B1 | * | 5/2001 | Herlfterkamp et al. | 156/314 |

FOREIGN PATENT DOCUMENTS

| | | | | |
|---|---|---|---|---|
| SU | 715390 | * | 2/1980 | 156/542 |

* cited by examiner

*Primary Examiner*—Jeff H. Aftergut
*Assistant Examiner*—John L. Goff
(74) *Attorney, Agent, or Firm*—Scott A. McBain

(57) ABSTRACT

An apparatus and method for dispensing labels onto cylindrical items includes an apparatus for applying a label onto a cylindrical object including a feed mechanism for feeding a label strip. A plate having a sharply angled separator edge is positioned to receive the label strip and peel a label from the label strip. A guide member has a pair of opposed rollers. The guide member and opposed rollers are positioned to receive the label. The opposed rollers are adapted to allow the cylindrical object to contact the label and affix the label to the cylindrical object as the cylindrical object is passed between the opposed rollers.

19 Claims, 2 Drawing Sheets

APPARATUS AND METHOD FOR DISPENSING LABELS ONTO CYLINDRICAL ITEMS

TECHNICAL FIELD

The subject invention relates to the field of labeling machines, and more particularly, to a relatively compact apparatus for applying pressure sensitive labels to cylindrical articles.

BACKGROUND OF THE INVENTION

The prior art relating to pressure sensitive labeling devices includes a wide variety of specialized machines comprising differing means of applying labels to bottles or containers. Because they are designed to apply labels to relatively large items, conveyor belts with mechanisms to automatically advance the items past a labeler mechanism are relatively simple to design. Further, when the items are bottles, cans or boxes it is relatively simple to design monitoring, timing and placement mechanisms to ensure proper location of each label.

Most pressure sensitive label machines differ from each other according to the nature of the objects to which they are designed to apply labels. For example, when the object is a relatively large item, such as a box, can or bottle, a conventional conveying mechanism may be used to convey and position each object into a position adjacent a labeling device. The device used to continuously apply pressure sensitive labels to objects that travel along the conveyor must be able to place a label onto a regular surface, either partly or entirely about a circumference of the container. For an application such as a bottle or can having a regular curved surface, a simple rotating vacuum drum or a vacuum swivel arm may be used to remove labels from a web and place the labels onto the container, since the surface curvature and distances to the object is predictable in each case.

Other devices use spaced rollers to press a label onto a passing article. Typically, the rollers are made of a material adapted to contact the article and thus, apply pressure to cause the label to adhere to the article. Other devices include fixed or moving plates to apply a label to an article having flat surfaces and/or corners.

However, small and narrow cylindrical articles present a special challenge to a labeling machine. In particular, it is more difficult to position a small, narrow cylindrical article accurately and apply a label. In regards to small cylindrical articles, it is difficult to position a label accurately onto the item, since it is more difficult to detect the position of and accurately index the article to be labeled. Therefore, it would be desirable to provide a system and method to accurately place labels onto a cylindrical object. It would further be desirable to provide a system and method to accurately place labels onto a cylindrical object wherein the apparatus is easily, quickly and inexpensively adapted to label objects of different cylindrical diameters and lengths.

SUMMARY OF THE INVENTION

One aspect of the present invention provides an apparatus for applying a label onto a cylindrical object including a feed mechanism for feeding a label strip. A plate having a sharply angled separator edge is positioned to receive the label strip and peel a label from the label strip. A guide member has a pair of opposed rollers. The guide member and opposed rollers are positioned to receive the label. The opposed rollers are adapted to allow the cylindrical object to contact the label and affix the label to the cylindrical object as the cylindrical object is passed between the opposed rollers.

In another aspect of the invention a guide member includes first and second vertical members that are spaced apart a first distance, the first distance being adapted to receive and guide the cylindrical object.

In another aspect of the invention a cylindrical object has a width, the first distance being a distance at least the width of the cylindrical object.

In another aspect of the invention a first distance between the vertical members includes a widened portion to permit removal of the cylindrical object having an end fitting, a width of the end fitting being substantially greater than the width of the cylindrical object.

In another aspect of the invention each of the first and second vertical members comprise front and back portions that are spaced apart a second distance, the second distance being adapted to receive and guide a label.

In another aspect of the invention the label has a width, the second distance being a distance at least the width of the label.

In another aspect of the invention the cylindrical object is a brake hose. The brake hose can include a crimped end fitting.

In another aspect of the invention the guide member further includes a narrow section between the back portions of the first and second vertical members adapted to permit passage of the crimped end fitting and deny passage of an un-crimped end fitting.

The present invention includes a method for applying labels to a cylindrical object including feeding a label strip having labels temporarily attached to a backing. A label is detached from the backing, the label having a length greater than a circumference of the cylindrical object. The label is guided into a guide member and onto a pair of opposed rollers. A label is applied to the cylindrical object as the cylindrical object contacts the label and passes between the opposed rollers.

In another aspect of the present invention the label is detached from the backing by moving the backing over a sharply angled separator edge of a plate and peeling the label from the backing, thereby providing an exposed adhesive side of the label in an upward facing condition.

In another aspect of the present invention the length of the label after being applied to the cylindrical object provides a pair of trailing ends of the label, the trailing ends being pressed into mutual engagement by the opposed rollers after the cylindrical object is passed between the opposed rollers.

Another aspect of the present invention further includes spacing a first and second vertical member of the guide to a first distance, the first distance being at least a width of the cylindrical object.

Another aspect of the present invention further includes spacing a front and back portion of each of the first and second vertical members a second distance, the second distance being at least a width of the label.

Another aspect of the present invention further includes advancing the cylindrical object through a narrow section between the back portions of each of the first and second vertical members, the narrow section adapted to permit passage of a crimped end fitting fixed to an end of the cylindrical object and deny passage of an un-crimped end fitting.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DESCRIPTION OF THE PREFERRED EMBODIMENT

Figure 1:
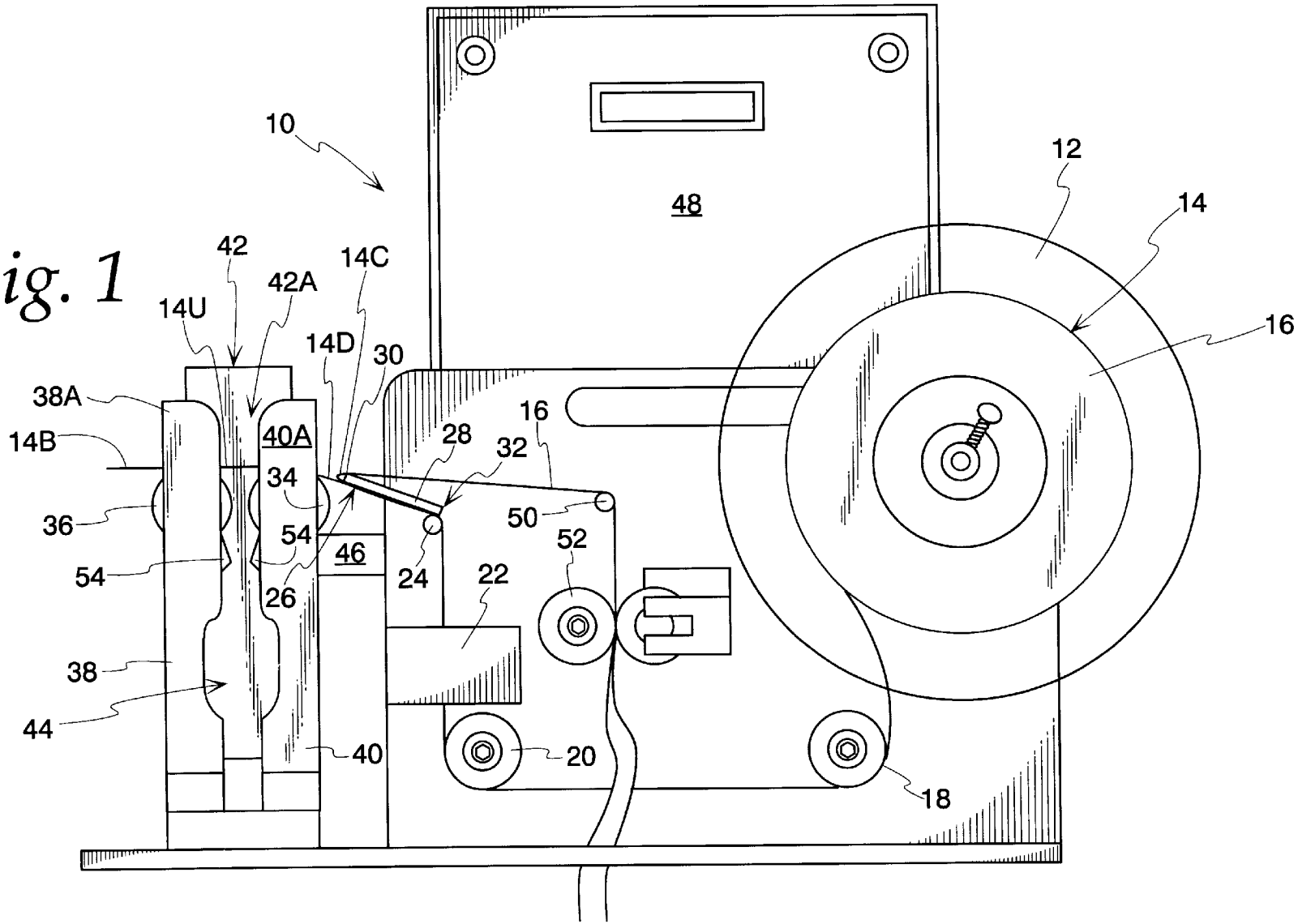
FIG. 1 is a schematic view illustrating one embodiment of an apparatus embodying the present invention.
Figure 2:
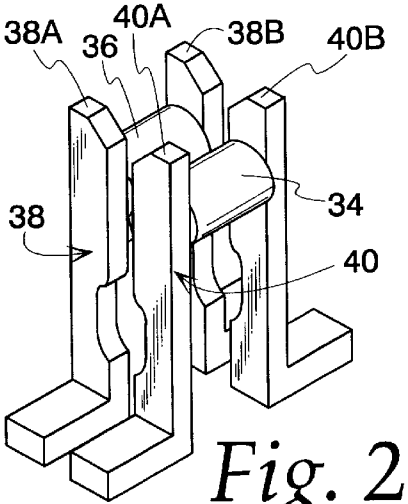
FIG. 2 is an illustration of an embodiment of the present invention.

Referring to FIGS. 1 and 2, the apparatus illustrating an embodiment of the present invention comprises a label dispensing system or device, generally indicated at 10. This device 10 includes a dispensing reel 12 including a fill of pre-printed labels 14 supplied on a label carrier web or backing 16. The label carrier web 16 can travel from the dispensing reel 12 around a first idler 18 and a second idler roller 20. The labels 14 may have printed thereon trademarks, advertising information, identifying media (including date and SKU information), or any other printed information including text, graphics and bar-coded data. These labels 14 may be attached to the backing 16 by means of a normally tacky adhesive commonly referred to in the art as a pressure-sensitive adhesive. The adhesive is pre-applied to the under-surface of the labels 14 and tends to have a greater affinity for the labels 14 than for the backing 16 so that when the labels are peeled or stripped from the backing the adhesive is removed with them. Thus, the labels 14, after being detached from the backing material 16, have an exposed adhesive surface.

From the second idler roller 20, the label carrier web 16 may travel through or along a label sensor 22. Label sensors 22 are well known in the art. For example, the label sensor 22 may be a standard "photo eye" or photo-detecting sensor. As the web 16 travels along the sensor 22, light emitted by the sensor 22 is blocked by a label 14, but not blocked by the web backing material 16 upon which the labels 14 are affixed. Thus, between labels 14, (which, in one embodiment is a gap of about ⅛") light is transmitted through the backing material 16 and is detected by the sensor 22. In response to the light transmitted through the web 16, the sensor 22 can transmit a signal, complete a circuit or cause a relay to close or open. This signal can correspond to a "STOP" instruction or signal that causes activation of a solenoid, or like device, the operation of which in the context of the present apparatus will be described more fully hereinafter.

After passing through the sensor 22, the label carrier web 16 can travel to a first fixed pin 24, or the like. The first pin 24 orients the web 16 to a direction almost parallel to a first or bottom surface 26 of a generally flat separator plate 28. The web 16 wraps around a sharp edge 30 of the plate 28 and is sharply turned across a second or top surface 32 of the plate. The narrow radius of the sharp edge 30 of the plate 28 causes the labels **14*d*, which at this detaching or peeling point are located on the outer radius of the bent web 16 and are generally stiffer or more rigid than the backing web material 16, to become detached from the backing web and ejected from the backing web. Since the plate 28 is oriented with the first and second surfaces 26, 32 in a generally horizontal orientation, the label 14*d* is ejected in a generally horizontal direction from the backing material 16**.

Each detached label **14*d* may be allowed to fall or drop onto a resting position upon a pair of opposed open cell foam rollers 34, 36. The label 14*d* is oriented on the backing material 16 such that the adhesive side 14*u*** is left exposed on the top surface of the label.

Each of the opposed foam rollers 34, 36 can be attached to one of a pair of vertical parallel beams 38, 40. The foam rollers 34, 36 may be allowed to rotate or may be fixed in place. The beams 38, 40 are laterally movable to accommodate different sized items and define a vertical slot 42 therebetween. In one embodiment, the bottom of the slot 42 may have the form of an enlarged opening 44 or keyhole to enable the removable of cylindrical items that have ends or portions with different diameters than a mid-portion.

Adjacent or below the foam rollers 34, 36 a second sensor 46, similar to the first sensor 22, is placed to detect the passage of an item through the slot 42 defined between the pair of beams 38, 40. The beams 38, 40 can include narrow portion 54. When an object passes before the sensor 46, a signal or like indicator is sent to a control unit 48. The control unit 48 may be a control unit adapted to operate with photo sensors such as a Banner Relay System (Model No. CL5RA). In operation, the control unit 48 can be configured such that receipt of a signal from the second sensor 46 can set the web 16 into motion to supply a new label 14, while receipt of a signal from the first sensor 22 can stop the advancement of the web. After removal of a label **14*d* from the backing web 16, the remaining backing material may be pulled over a second pin 50 by a pair of pull wheels 52, or the like. An electrical motor (not shown) or any suitable advancing apparatus may drive the pull wheels 52, the motor being responsive to control from the control unit 48**. It should be understood that any feed mechanism including an arrangement of rollers, pins, non-driven or driven wheels or rollers or the like, can be employed to advance a web to provide a label to a cylindrical object as set forth herein.

In operation, after the system 10 has ejected a label **14*d* onto the foam rollers 34,36 an end or middle portion of a cylindrical item (a wire, rope, cable, hose or the like) is placed into the top end 42*a* of the slot 42 defined by beams 38, 40 and pressed onto the label 14*d* by an operator (not shown). The item is preferably pressed through the rollers 34, 36 in a downward direction. The act of depressing the item through the foam rollers 34, 36 causes the label 14*d* to wrap around the circumference of the item. Preferably, with narrow or small diameter items the label 14*d* will be longer than the circumference of the item so that the "tails" 14*b*, 14*c* (or ends) of the label 14*d* adhere to each other and provide an easy-to-read tail or flag portion of the label. The foam rollers 34,36 conform to the shape of the item and press the ends 14*b*, 14*c* of the label 14*d*** together causing the ends to adhere to each other and form the flag portion.

The second sensor 46 can detect the presence of the item and can relay a signal to the control unit 48. The control unit 48 causes the advancement of the web 16 until a signal from the first sensor 22 detects the presence of a gap or space between labels 14 (meaning that an entire label has passed the first sensor 22).

Figure 4:
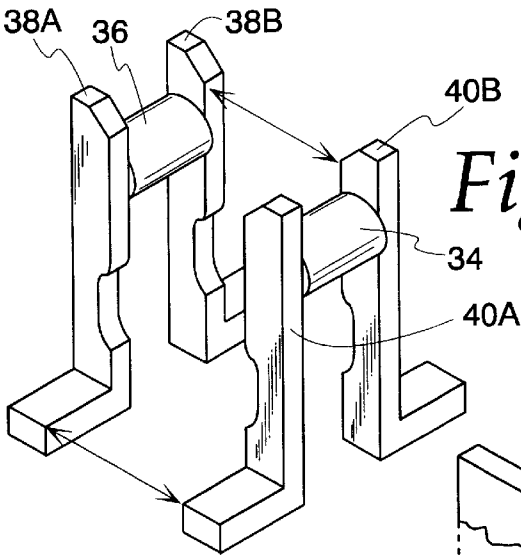
FIG. 4 is an illustration of a portion of the device shown in FIG. 2 showing another adjustable feature of an embodiment of the invention.
Figure 6:
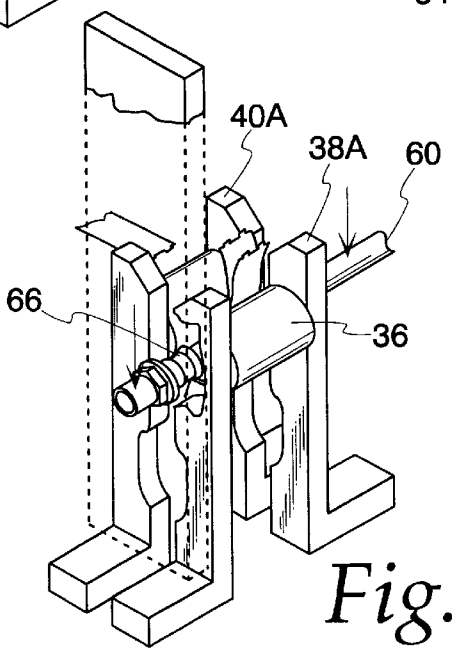
FIG. 6 is an illustration of a portion of the device shown in FIG. 5 after the object has been labeled.
Figure 3:
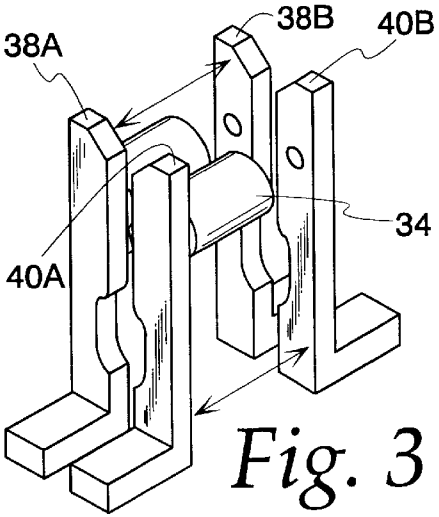
FIG. 3 is an illustration of a portion of the device shown in FIG. 2 showing an adjustable feature of an embodiment of the invention.

As shown in FIGS. 3–4, it will be understood that the span between the vertical beams 38, 40 can be configured to accept various diameter items. In other words, the vertical beams 38, 40 can be provided with the ability to adjust laterally. To this end, the beams may be separate and fitted to into slots or grooves for lateral adjustability, as is known in the art, or any arrangement that allows the space to be modified. In an alternate embodiment, the beams 38, 40 can be a single joined beam unit that can be substituted for a differently spaced beam unit. Similarly, the foam rollers may be easily changed to accommodate various diameter items. In this manner, the present invention demonstrates the advantage of being easily, quickly and inexpensively converted to apply labels to a broad range of objects.

As shown in FIGS. 1–2, the web 16 is directed upon the sharp edge 30 of plate 28. Labels 14*d* are peeled off thereby and directed upon from backing material 16 to a resting position upon rollers 34, 36 with the adhesive side 14*u* of the label in an upwardly exposed condition. Front and back portion 38*a*, 38*b* of member 38 and front and back portion 40*a*, 40*b* of member 40 operate to guide and bracket the peeled label 14*d* into place upon the rollers 34,36. It will be understood that these front and back portions can be mounted as to be movable to provide a variable gap therebetween. Further, as shown if FIG. 2, the rear portions 38*b*, 40*b* may include a narrow section 54.

Figure 5:
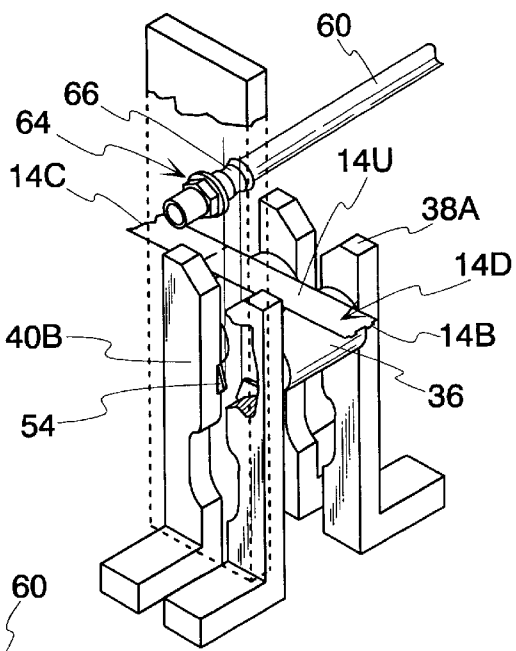
FIG. 5 is an illustration of a portion of the device shown in a rear view of FIG. 2 showing an object positioned for label application.

As shown in FIG. 5, the cylindrical object may include a brake hose 60. Typically, brake hoses are narrow cylindrical objects that include a terminal or end fitting 64 that is affixed to the end of the brake hose 60 by crimping. The present invention includes narrow section 54 which when the terminal fitting of the brake hose 62 is passed downwardly through the vertical members 38,40 (FIG. 1) is sized to allow a crimped (narrow) portion 66 of the fitting to pass and prevents an non-crimped fitting from passing. In this manner, a brake hose that does not possess a properly crimped end fitting is brought to the attention of the operator. Thus, the vertical members 38, 40 of apparatus 10 can be provided with a "no-go" gauge or section 54 that operates to include a quality check as part of the labeling process.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein. We claim:

What is claimed is:

1. An apparatus for applying a label to a cylindrical object comprising:

a feed mechanism;

a plate having a separator edge positioned to receive a label strip from the feed mechanism and peel a label from the label strip; and a guide member having a pair of opposed rollers, the guide member and opposed rollers positioned to receive the label, the opposed rollers adapted to allow the cylindrical object to contact the label and affix the label to the cylindrical object as the cylindrical object is passed between the opposed rollers; and a first and second vertical member that are spaced apart a first distance, the first distance being adapted to receive and guide the cylindrical object.

2. The apparatus of claim 1 wherein the cylindrical object has a width, the first distance being a distance at least the width of the cylindrical object.

3. The apparatus of claim 2 wherein the first distance between the first and second vertical members includes a widened portion to permit removal of the cylindrical object having an end fitting, a width of the end fitting being substantially greater than the width of the cylindrical object.

4. The apparatus of claim 1 wherein each of the first and second vertical members comprise a front and a back portion that are spaced apart a second distance, the second distance being adapted to receive and guide a label.

5. The apparatus of claim 1 wherein the separator edge is sharply angled.

6. The apparatus of claim 1 wherein the separator edge is positioned to position the label in a substantially horizontal position.

7. The apparatus of claim 1 wherein the separator edge is positioned to position the label with an adhesive side facing upward.

8. The apparatus of claim 7 wherein the guide member is positioned to receive the substantially horizontally positioned label.

9. The apparatus of claim 8 wherein the guide member is positioned to allow a cylindrical object to contact the label in a middle region of the label.

10. The apparatus of claim 4 wherein the label has a width, the second distance being a distance at least the width of the label.

11. The apparatus of claim 4 wherein the pair of opposed rollers are positioned to allow a brake hose to pass between the opposed rollers.

12. The apparatus of claim 11 wherein the guide member further comprises a narrow section between the back portions of the first and second vertical members adapted to permit passage of the crimped end fitting and deny passage of an un-crimped end fitting.

13. A method for applying labels to a cylindrical object comprising:

feeding a label strip having labels temporarily attached to a backing;

detaching a label from the backing, the label having a length greater than a circumference of the cylindrical object;

guiding the label into a guide member and onto a pair of opposed rollers; and applying the label to the cylindrical object as the cylindrical object contacts the label and passes between the opposed rollers.

14. The method of claim 13 wherein the label is detached from the backing by moving the backing over a sharply angled separator edge of a plate and peeling the label from the backing, thereby providing an exposed adhesive side of the label in an upward facing condition.

15. The method of claim 13 wherein the length of the label after being applied to the cylindrical object provides a pair of trailing ends of the label, the trailing ends being pressed into mutual engagement by the opposed rollers after the cylindrical object is passed between the opposed rollers.

16. The method of claim 13 further comprising:

spacing a first and second vertical member of the guide to a first distance, the first distance being at least a width of the cylindrical object.

17. The method of claim 16 further comprising:

spacing a front and back portion of each of the first and second vertical members a second distance, the second distance being at least a width of the label.

18. The method of claim 17 further comprising:

advancing the cylindrical object through a narrow section between the back portions of each of the first and second vertical members, the narrow section adapted to permit passage of a crimped end fitting fixed to an end of the cylindrical object and deny passage of an un-crimped end fitting.

19. A system for applying a label to a brake hose comprising:

means for feeding a label strip;

means for detaching a label from the label strip;

means for guiding the peeled label to a predetermined position;

means for guiding the brake hose to contact the label; and means for affixing the label to the brake hose.

* * * * *